United States Patent [19]

Nakao

[11] 4,138,151

[45] Feb. 6, 1979

[54] DETENT DEVICE FOR LOCKING THE LID OF A CASSETTE RECEIVING COMPARTMENT OF A TAPE RECORDER

[75] Inventor: Toshihiro Nakao, Hachioji, Japan

[73] Assignee: Olympus Optical Company Limited, Tokyo, Japan

[21] Appl. No.: 819,573

[22] Filed: Jul. 27, 1977

[51] Int. Cl.[2] ..... E05C 19/06; E05C 19/02

[52] U.S. Cl. ..... 292/76; 292/341.12; 292/341.15; 292/DIG. 38

[58] Field of Search ..... 292/76, 77, 80–87, 292/91, 17, 19, 152, 209, 303, 341.12, 341.15, 341.17, DIG. 38, DIG. 73

[56] References Cited

U.S. PATENT DOCUMENTS

| | | | |
|---|---|---|---|
| 1,068,899 | 7/1913 | Hepburn | 292/76 |
| 1,479,398 | 1/1924 | Ollard | 292/341.12 |
| 1,581,693 | 4/1926 | Seeholzer | 292/76 |
| 1,896,363 | 2/1933 | Johnson | 292/341.12 X |
| 3,038,747 | 6/1962 | Rapata | 292/DIG. 38 X |
| 3,151,899 | 10/1964 | Kelley | 292/DIG. 38 X |
| 3,797,870 | 3/1974 | Beckman | 292/DIG. 38 X |

FOREIGN PATENT DOCUMENTS

| | | | |
|---|---|---|---|
| 2340588 | 2/1975 | Fed. Rep. of Germany | 292/76 |
| 201111 | 1/1966 | Sweden | 292/80 |

*Primary Examiner*—Roy D. Frazier
*Assistant Examiner*—William E. Lyddane
*Attorney, Agent, or Firm*—Toren, McGeady and Stanger

[57] ABSTRACT

A device for locking the lid of a cassette tape receiving compartment of a cassette tape recorder including a lock member projecting from a portion of the lid and a generally U-shaped lock spring provided at one end of one leg thereof with a first projection engaging the lock member of the lid during opening and closing thereof. A second projection on the one leg of the lock spring engages against a ledge formed in the recorder casing in order to modify the spring force applied by the lock spring against the lid.

3 Claims, 9 Drawing Figures

DETENT DEVICE FOR LOCKING THE LID OF A CASSETTE RECEIVING COMPARTMENT OF A TAPE RECORDER

BACKGROUND OF THE INVENTION

1. Field of the Invention

The present invention relates to a device for locking an opening and closing lid of a cassette tape inserting portion for a cassette tape recorder.

2. Description of the Prior Art

In general, in case of recording and reproduction, the cassette tape recorder is set in the predetermined operating mode and operated under appropriate condition.

During operation, the lid of the tape recorder is prevented from opening due to external vibration or the like.

Recently, a super miniature cassette tape recorder has been used, and such tape recorder can be used not only in a certain positions but also in a variety of positions.

In such tape recorder, it is necessary to lock the closing state of the lid of the cassette tape inserting portion to enable use of the device in a variety of positions.

SUMMARY OF THE INVENTION

An object of the present invention is to satisfy the above mentioned necessity.

Another object of the present invention is to provide a device for locking the lid in which the lid under the closed state is positively locked and the construction is simple so as to be assembled even in a narrow space.

According to the present invention a device for resiliently locking the lid of a casing of a tape recorder, said casing including means defining an opening for a cassette receiving compartment of said recorder with said lid being mounted on said casing to open and close said opening, comprises a generally U-shaped lock spring having a pair of resilient legs and provided near the end of one of the said legs with a first projection, compartment means formed in the casing for operatively housing said lock spring in operative position, a lock member formed to project from a part of the lid and arranged to engage at the first projection of the lock spring thereby to cause to be applied to the lid during opening and closing thereof a spring force developed by the U-shaped lock spring, a second projection formed on the one leg of the lock spring, and means defining a ledge in the compartment housing the lock spring. The second projection on the leg of the lock spring engages the ledge against the spring force of the lock spring, with this engagement between the second projection and the ledge in the compartment means operating to modify the spring force applied to the lid by the engagement between the lock member and the first projection.

On the surface of the periphery of said opening is formed a small projection, thereby supporting said lid when closing. At least one of the securing portion of the lock spring is projected above the surface of the periphery of the opening, and said lid is supported at this portion when closing.

DESCRIPTION OF THE PREFERRED EMBODIMENT

Figure 1:
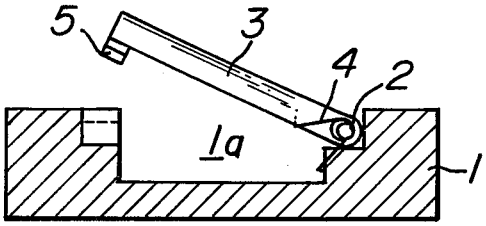
FIG. 1 is a longitudinal cross-section showing one embodiment of the device for locking an opening and closing lid according to the present invention.

Referring to FIG. 1, a cassette tape recorder casing 1 is provided with a lid 3 at a cassette tape inserting portion 1*a* through a hinge 2, so as to open and close the inserting portion 1*a*. In this case, the pivot portion of the lid 3 is provided with a spring 4 for biasing the lid 3 in the opening direction. The lid 3 is projected at the end as shown in FIG. 2 and provided with a lock member 5 having a downward projection 5*a*.

Figure 2:
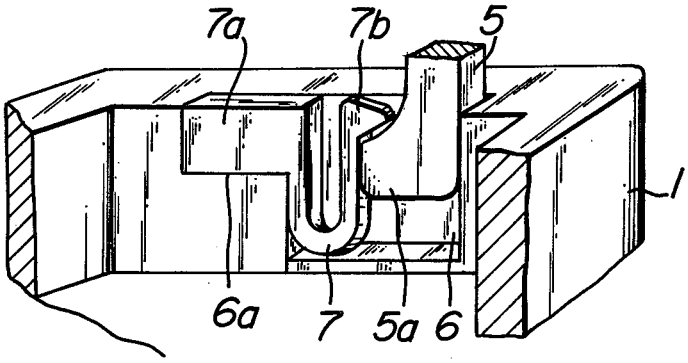
FIG. 2 is a perspective view showing the lock portion of FIG. 1.

At the side wall of the cassette tape inserting portion 1*a* in opposition to the end of the lid 3 is formed a notch 6 having a step 6*a*, and in this notch 6 is provided a generally U-shaped lock spring 7 for locking the lock member 5 as shown in FIG. 2. The spring 7 in this case is integrally formed of plastics, and the elasticity of this plastic is utilized. The spring 7 is generally formed into a U-shape, with one leg member being formed with a securing portion 7*a*, while the other leg thereof is formed with a projection 7*b*. The lock spring 7 is adhered to the step 6*a* of the notch 6 at the securing portion 7*a* within the notch 6 as illustrated.

Figure 3:
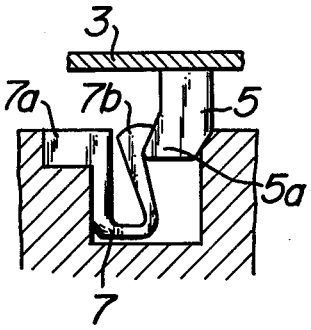
FIGS. 3 and 4 are cross-sectional views explaining the same embodiment, respectively.
Figure 4:
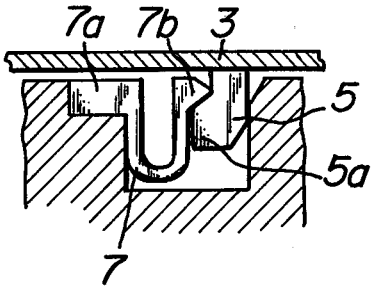

According to the above construction, when the lid 3 is closed for closing the cassette tape inserting portion 1*a*, the projection 5*a* at the end of the lock member 5 of the lid 3 as shown in FIG. 3 presses the projection 7*b* of the spring 7 leftwardly as illustrated. As shown in FIG. 4, when the projection 5*a* of the lock member 5 passes through the projection 7*b* of the spring 7, the projection 5*a* is engaged by a spring force to the right as illustrated so as to prevent slipping, thereby locking the lid 3.

Thereafter, when the lid 3 is opened, pressure force in an upward direction is applied to the lid 3 by operation of an eject level (not shown). Then, the lock member 5 is thrust upwards against the bias force of the spring 7, so that the lid 3 is opened with the bias force of the spring 4.

According to the present invention, the lid under the closed condition is positively locked, so that the recorder is usable in every position even with super miniature tape recorders. Further, the lock portion is of a simple construction with a spring only and can be secured to the notch step of the casing side wall, so that it can easily be assembled into a narrow space. Further, in this embodiment, the spring of the lock portion is a molded product utilizing elasticity of plastics, so that parts precision can be determined by mold precision of plastics and stable spring characteristic can be obtained.

Figure 5:
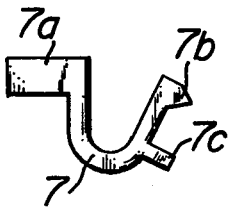
FIG. 5 is a front view of the lock spring used in another embodiment of the present invention.
Figure 6:
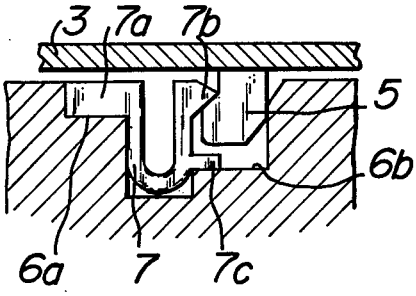
FIG. 6 is a cross-sectional view showing the lock portion of another embodiment.

FIGS. 5 and 6 show another embodiment of the present invention. That is, as shown in FIG. 5, in the middle of the leg member provided with the projection 7*b* of the lock spring 7 is formed the engaging member or second projection 7*c*, while in the notch 6 of the casing 1 for inserting the spring 7 is formed the step or ledge 6*b* as shown in FIG. 6, and in this case, by the engagement of the engaging member *7c* with the step *6b* the spring force of the spring 7 is modified and the spring is compressed by a predetermined angle.

In this manner, material having strong elasticity can be used for the spring 7, so that it can be made to provide a stronger locking force on the lock member 5 of the lid 3.

Figure 7:
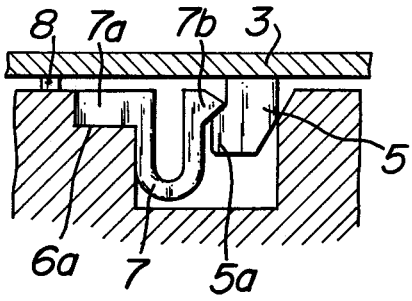
FIGS. 7 and 8 are another embodiments of the present invention, respectively.

In the above embodiment, there is shown a construction wherein the lid 3 is in contact with the entire surface of the periphery of the cassette tape inserting portion, but it is preferable to make the contact area smaller for stabilizing the lid 3 when closing, and a small projection 8 is formed as shown in FIG. 7 and the lid 3 is supported thereby.

Figure 8:
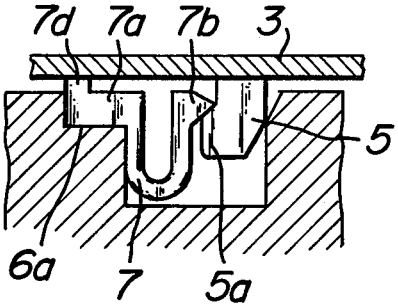

As shown in FIG. 8, it can be possible to project at least a part of the securing portion *7a* of the spring 7 upwards and the lid 3 is supported by this projection *7d*.

Figure 9:
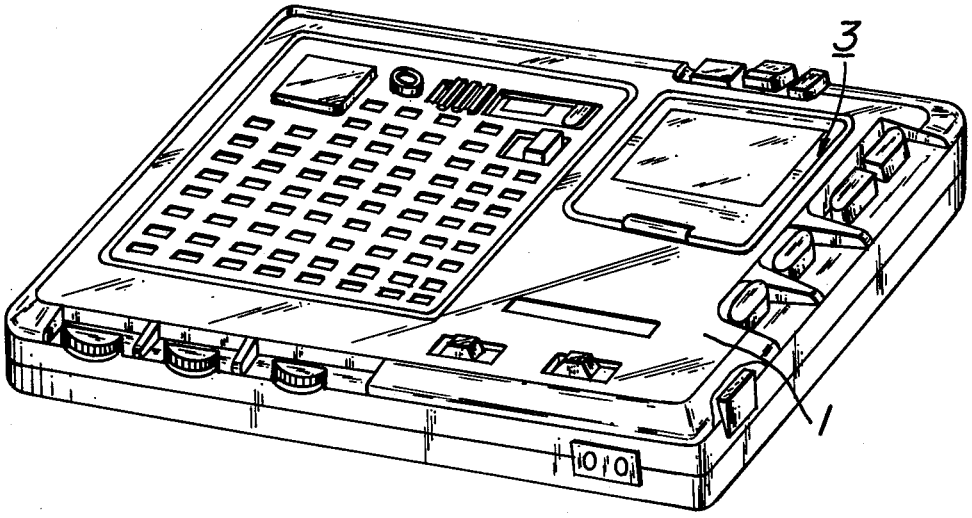
FIG. 9 is a perspective view showing an external appearance of the cassette tape recorder by applying the lock device according to the present invention to the cassette inserting portion.

FIG. 9 is a perspective view showing the external appearance of the cassette tape recorder by applying the lock device according to the present invention to the cassette tape inserting portion.

Although, in the above embodiments, the lock spring 7 is formed separately from the casing 1 the spring 7 can be integrally formed with the casing 1 by molding.

Further, in the above embodiment, the lock spring is formed of plastics, for example, acrylic resin, polypropylene and the like, but other materials are usable.

As described above, according to the present invention, the lid in the closed state can be positively locked, and the construction is simple, and assembling is easy even in a narrow space, so that the present invention can provide a convenient device for locking the opening and closing lid.

The various features of novelty which characterize the invention are pointed out with particularity in the claims annexed to and forming a part of this disclosure. For a better understanding of the invention, its operating advantages and specific objects attained by its use, reference should be had to the accompanying drawings, and descriptive matter in which there are illustrated and described preferred embodiments of the invention.

What is claimed is:

1. A resilient detent device for the lid of a casing including means defining an opening with said lid being mounted on said casing to open and close said opening, said detent device comprising a generally U-shaped lock spring having a pair of resilient legs and provided near the end of one of said legs with a first projection, compartment means formed in said casing for operatively housing therein said lock spring in operative position, a lock member formed to project from a part of said lid and arranged to engage said first projection of said lock spring thereby to cause to be applied to said lid during opening and closing thereof a spring force developed by said U-shaped lock spring, a second projection formed on said one leg, and means defining a ledge in said compartment means, said second projection being engaged on said ledge against the spring force of said lock spring, with the engagement between said second projection and said ledge operating to modify the spring force applied to said lid by the engagement between said lock member and said first projection.

2. A device according to claim 1 further including a small projection located at the periphery of said opening, said small projection being arranged to be abutted by said lid when said lid is in a closed position.

3. A device according to claim 2 wherein said small projection formed at the periphery of said opening is formed as an integral part of said lock spring.

* * * * *

UNITED STATES PATENT OFFICE

CERTIFICATE OF CORRECTION

Patent No. 4,138,151 Dated Feb. 6, 1979

Inventor(s) TOSHIHIRO NAKAO

It is certified that error appears in the above-identified patent and that said Letters Patent are hereby corrected as shown below:

In the heading of the patent [30] should read as follows:

[30] Foreign Application Priority Data

July 30, 1976 Japan.....51-102528

Signed and Sealed this

*Seventh* Day of *August 1979*

[SEAL]

*Attest:*

*Attesting Officer*

LUTRELLE F. PARKER

*Acting Commissioner of Patents and Trademarks*